United States Patent [19]

Dentler et al.

[11] Patent Number: 4,574,408

[45] Date of Patent: Mar. 11, 1986

[54] LIFTING DEVICE FOR USE IN A BATH TUB

[76] Inventors: Wolfgang Dentler, Leutkirch-Merazhofen, Fed. Rep. of Germany, 7970; Peter Endres, Ringweg 14, Isny/Neutrauchburg, Fed. Rep. of Germany, 7972

[21] Appl. No.: 659,263

[22] Filed: Oct. 10, 1984

[30] Foreign Application Priority Data

Oct. 14, 1983 [DE] Fed. Rep. of Germany ..... 3337536

[51] Int. Cl.[4] ..... A47K 3/12

[52] U.S. Cl. ..... 4/560; 4/566

[58] Field of Search ..... 4/560–566, 4/558

[56] References Cited

U.S. PATENT DOCUMENTS 4,407,029 10/1983 Schmidt ..... 4/564

4,419,776 12/1983 Schmidt ..... 4/564

FOREIGN PATENT DOCUMENTS 3134513 3/1983 Fed. Rep. of Germany .

2117236 10/1983 United Kingdom ..... 4/564

*Primary Examiner*—Stephen Marcus

*Assistant Examiner*—L. J. Peters

*Attorney, Agent, or Firm*—Lackenbach, Siegel, Marzullo, Presta & Aronson

[57] ABSTRACT

The lifting device for use in a bath tub consists of a bottom frame, lying on the ground of a bath tub, and an upper frame which is in parallel to the bottom frame and adjustable in height, and a supporting plate being fixed on the upper frame. Between the bottom frame and the upper frame is arranged a pantograph type frame consisting of two interconnected slewing frames. In order to reach a large lifting height, a Z-shaped lifting hose is sectionally fastened at the slewing frame in such a way that the horizontal hose sections prop against correspondent and adjacent inclined hose sections. By this, in order to reach a large lifting height, not only the variation of length but also the increase of width of the lifting hose are used when supplying the hose with compressed water.

7 Claims, 9 Drawing Figures

LIFTING DEVICE FOR USE IN A BATH TUB

Figure 1:
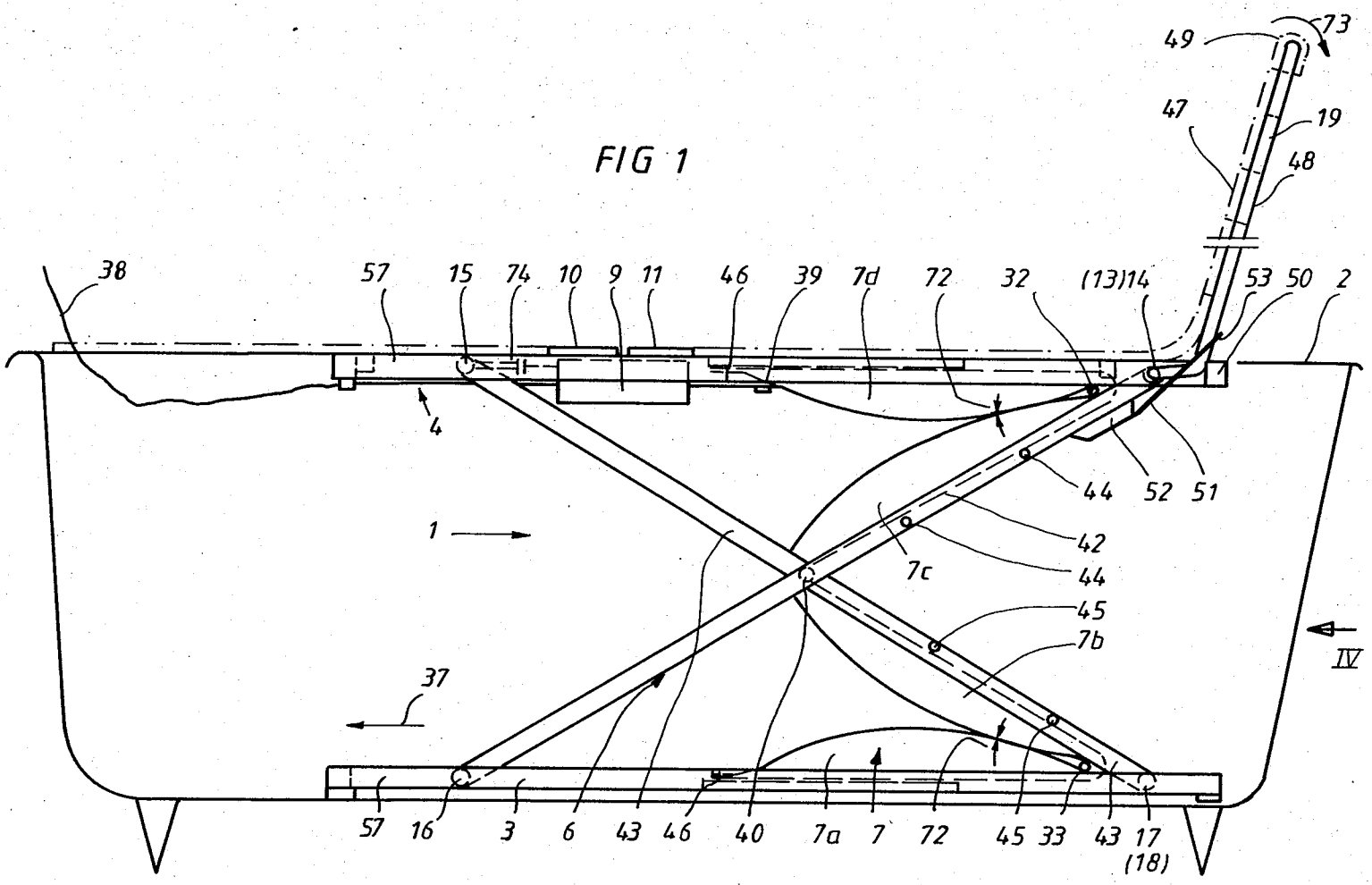

The invention discloses a lifting device for use in a bath tub.

A lifting device has been made known by German Patent Application DE-OS No. 31 34 513. In this application, the pantograph type frame consists of two pantographic hinges arranged in parallel at a certain distance; each pantographic hinge coordinates one lifting hose. This arrangement has the disadvantage that the maximum lifting height is only 420 mm. Therefore, such a lifting device is not appropriate for deep bath tubs. Moreover, because of the use of two homogeneous pantographic hinges, the production is relatively complicated and expensive; finally, there is an increased danger of jamming when operating the lifting device.

The low lifting height results from the necessity to arrange two pantographic hinges one after the other at a certain distance within the limited construction length (adapted to the length of the bath tub). Each pantographic hinge must define a longitudinal moving path so that, because of the limitation of the moving path, the lifting height is very much reduced.

The present invention has set itself the task of developing a lifting device of the above mentioned kind in such a way that by use of equal or increased lifting force the lifting height is essentially increased.

For the solution of the problem posed, the invention is characterized in that the pantograph type frame consists of two interconnected slewing frames pivotable upon the center axle between the slewing frames, the Z-shaped lifting hose is sectionally fastened in such a manner that the horizontal hose sections prop against the corresponding and neighboring hose sections to form a cusp.

Thus it is an essential feature of the present invention that there is arranged only one pantograph type frame (pantographic hinge), and that the required Z-shaped lifting hose for lifting or lowering the pantograph type frame between the upper frame and the lower frame is arranged in such a manner that the horizontal hose sections prop against the corresponding and neighboring hose sections which are fastened at the slewing frame. By the given technical teaching, a new way is disclosed for the construction of lifting devices. Only by the application DE-OS No. 31 12 679 it has been known, for instance, to apply a lifting hose in a horizontal position and to transform the lifting motion into a vertical up and down motion with the aid of a complicated cinematic transformation device.

In application DE-OS No. 31 34 513, there are used two parallel and vertically arranged lifting hoses.

It is known to use linear deformations of the hose for the operation of the lifting device. Instead of this the variations of thickness (increase of diameter) of the lifting hose are used for operation of the lifting device.

The hose is sectionally folded in zig-zag fashion. When the hose is pumped up by a supply of compressed water, it increases its volume many times relative to its initial state; by this, the hose section at the lower frame, lying parallel to the frame, is able to prop against the hose section over it, arranged at the slewing arm. When pumping up the hose, the diameter of the lower hose section increases by 100 mm; the same happens in all other hose sections. When the hose sections are lying together, a mutual propping is effected as well in the lower section as in the upper section of the pantograph type frame. Under the upper frame, there is a hose section applied to the other slewing arm, propped with its surface against the underside of the hose section attached to the upper frame, so that here, once more, a lifting height of 20 cm is reached. Since the two slewing arms of the pantograph type frame are slewable towards each other, a lifting height of at least 40 cm necessarily results, totally a lifting height of about 52 cm.

Hitherto it has been impossible to reach such a lifting height by such simple means, guaranteeing a high carrying power of 250 kg for example.

In the present embodiment, the hose has a diameter of 100 mm. If a hose with a larger diameter would be chosen, both the lifting force and the lifting height were increased.

An esssential feature of the present invention is the fact that hose sections in series press and prop one against another by the guiding of the hose between the slewing arms of the pantograph type frame.

In a first preferred embodiment of the present invention, this is reached by propping the hose section, attached to the lower frame, against the lower frame itself. With this the lower frame can be provided with suitable supporting plates; just as well, suitable supporting struts or other supporting surfaces can be used.

It is a further feature of the present invention that the same supporting surface is also provided for the subsequent hose section at the slewing arm.

It is preferred that these supporting surfaces are reinforced by suitable supporting struts of the hose. These supporting struts are round profiles which stably interconnect the corresponding arms of the respective slewing arm. Instead of using supporting struts, corresponding supporting plates or other supporting profiles can be used.

For the respective hose sections, supporting surfaces at the slewing arms, at the bottom frame, and at the upper frame are provided; the lifting hose is arranged in such a way that it is leaning against these supporting surfaces with one side, whereas the opposite side is leaning against the adjacent hose section.

It is a further essential feature of the present invention that the longitudinal struts of the bottom frame and the upper frame are made of stable U-profiles, and that the cross struts are made of stable closed square tubes.

Using U-profiles arranged in longitudinal direction, a further advantage is that the rolls, mounted on the free ends of the slewing arms, are meshed into the U-profiles, being guided there in longitudinal direction. The result is a light and tiltless guiding of the slewing arms.

Using stable square profiles, it is not necessary to use, instead of a bottom frame, a known plastic plate on which are riveted or screwed suitable U-profiles. This would have the disadvantage that the plastic plate could be deformed by influence of forces, and, by this, the slewing gear could be jammed.

Using a stable upper frame with suitable metal profiles, it is a further advantage that a relatively light supporting plate (5) can be used, since mechanical stability is already reached by the upper frame.

The use of an open-work bottom frame and upper frame has the further advantage that the device can be cleaned easily.

A further essential advantage of the present invention is the arrangement of a height limitation device. As is well known, existing lifting devices have the disadvantage that they increase slightly the lifting height in the case of discharging, i.e. when the person upon the lifting device is leaving it. The cause is the negligible compressibility of the lifting hoses. Besides, in many cases of application it is desired that, for a definite height of the bath tub, an automatic limitation of the lifting height is provided. Thus it is impossible that the supporting plate upon the upper frame can be elevated higher than the border of the bath tub by the operating person. For this purpose, a height limitation stop is provided to that cause a locking of the pantograph type frame in its elevated position. By the height limitation stop the inlet valve is mechanically blocked up; the simplest blocking is to block the operating key (push button) for the inlet valve in the elevated position of the lifting device.

The height limitation stop consists of two symmetrical guide sleds rigidly interconnected by a connecting strut, the guide sleds being removable in longitudinal direction within a U-profile of the upper frame, the U-profile directed towards the interior of the frame. The displacement of the guide sled in longitudinal direction is made in the region of a guide opening, the guide sled consisting of a guide block having a longitudinal bore through which an axle is acting, on the front end of which is provided a stop block which, for stopping, is movable at a roll of the frontal end of the slewing frame.

In the elevated position of the lifting device the roll of the slewing frame is stopped by the stop block which is removed in longitudinal direction so that the guide block is likewise displaced in longitudinal direction by the axle at the stop block.

A cranked slewable control strut is mounted at the guide block in a direction normal to the longitudinal axis of the guide block. When the guide block is removed, the control strut is slewing and pressing against a control edge of the press key for the inlet valve. In this way the press key for the inlet valve will be blocked in the elevated position of the lifting device.

Instead of blocking the press key of the inlet valve, naturally, the valve tappet itself can be mechanically blocked.

It is important that the elevated position of the pantograph type frame can be stopped in any adjustable height. For this, the longitudinal displacement of the axle, traversing the guide block, is limited. This is, for example, reached by fixed spacers (for instance fixable clips) which are brought in between stop block and the frontal end of the guide block.

Further features of the invention are disclosed in the Figures and are clear to those skilled in the art.

The subject of the present invention does not only result from the features shown in the individual Figures but also from the interaction of the features disclosed in the Figures.

All disclosed specifications and features, especially the concrete embodiment shown in the drawings, are claimed as salient features of the inventiion, individually or in combination, as far as they are novel relative to the state of art.

In the following, the invention will be explained more specifically with reference to drawings which show several embodiments. From the drawings and their description further essential features and advantages of the invention will become evident.

Figure 2:
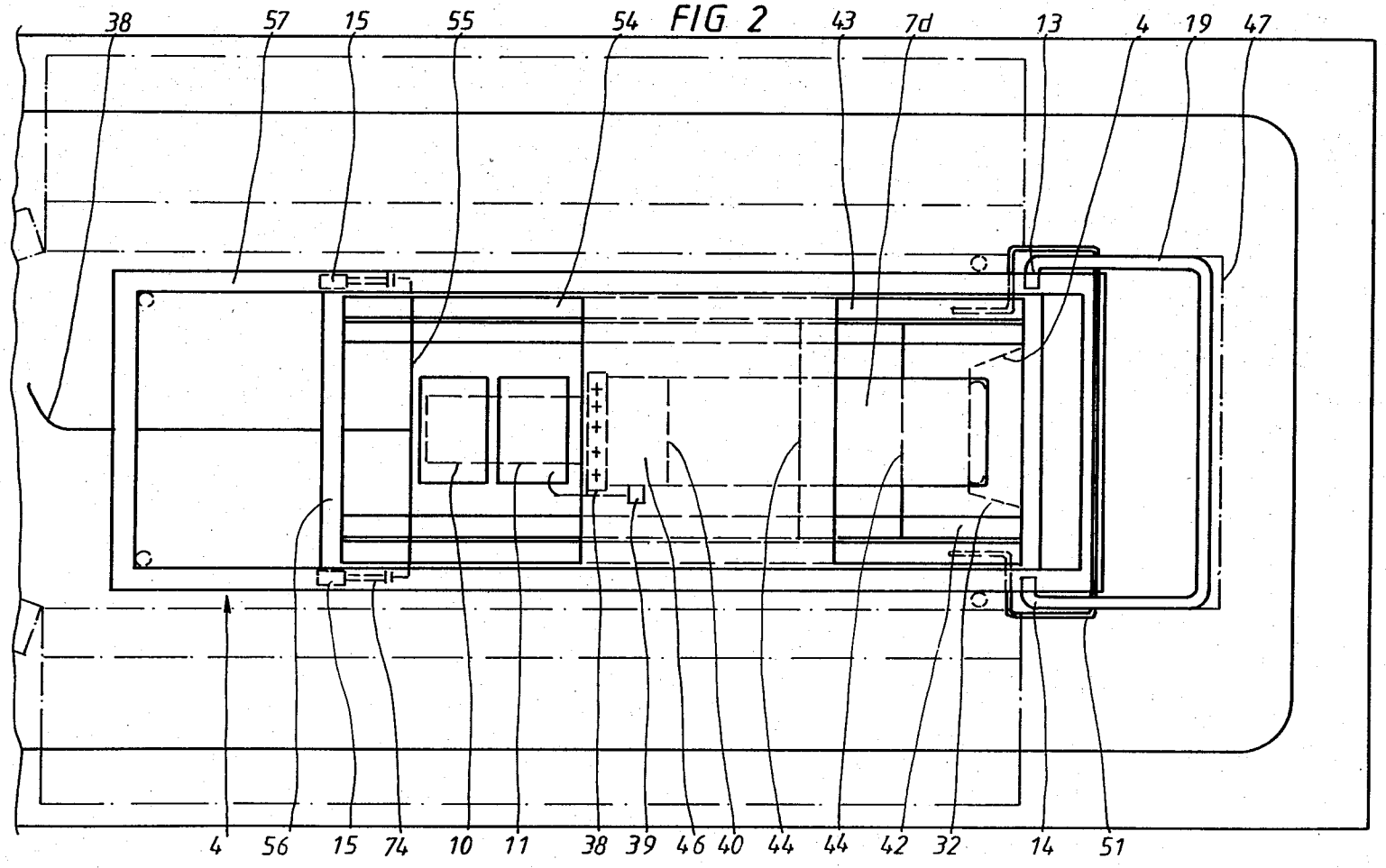
Figure 3:
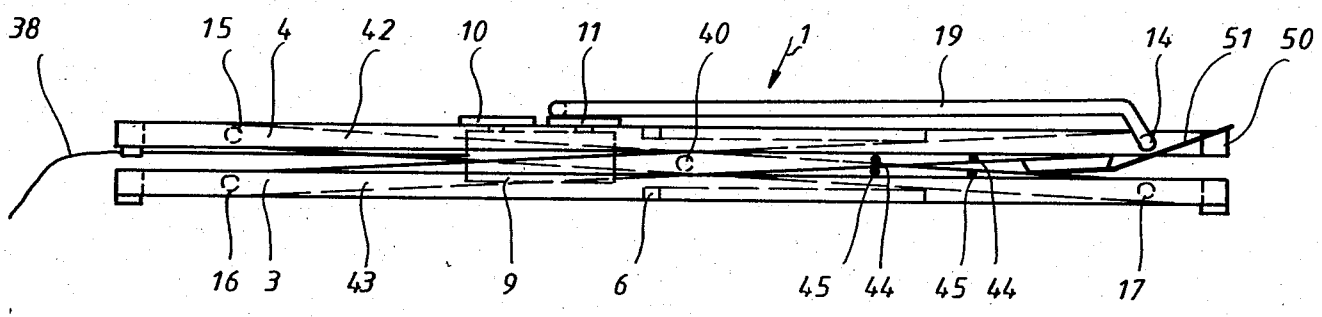
Figure 8:
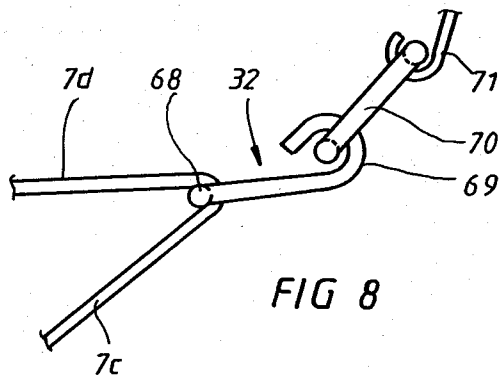
Figure 9:
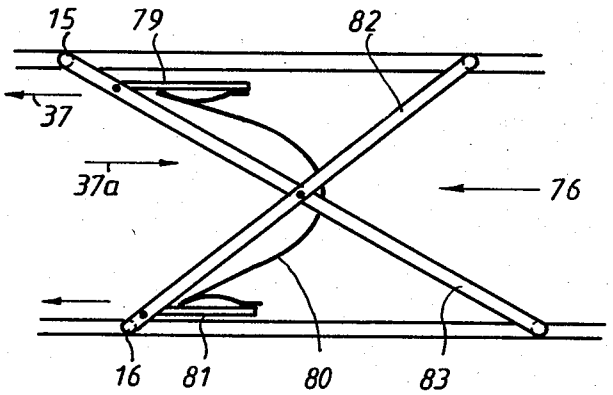
Figure 4:
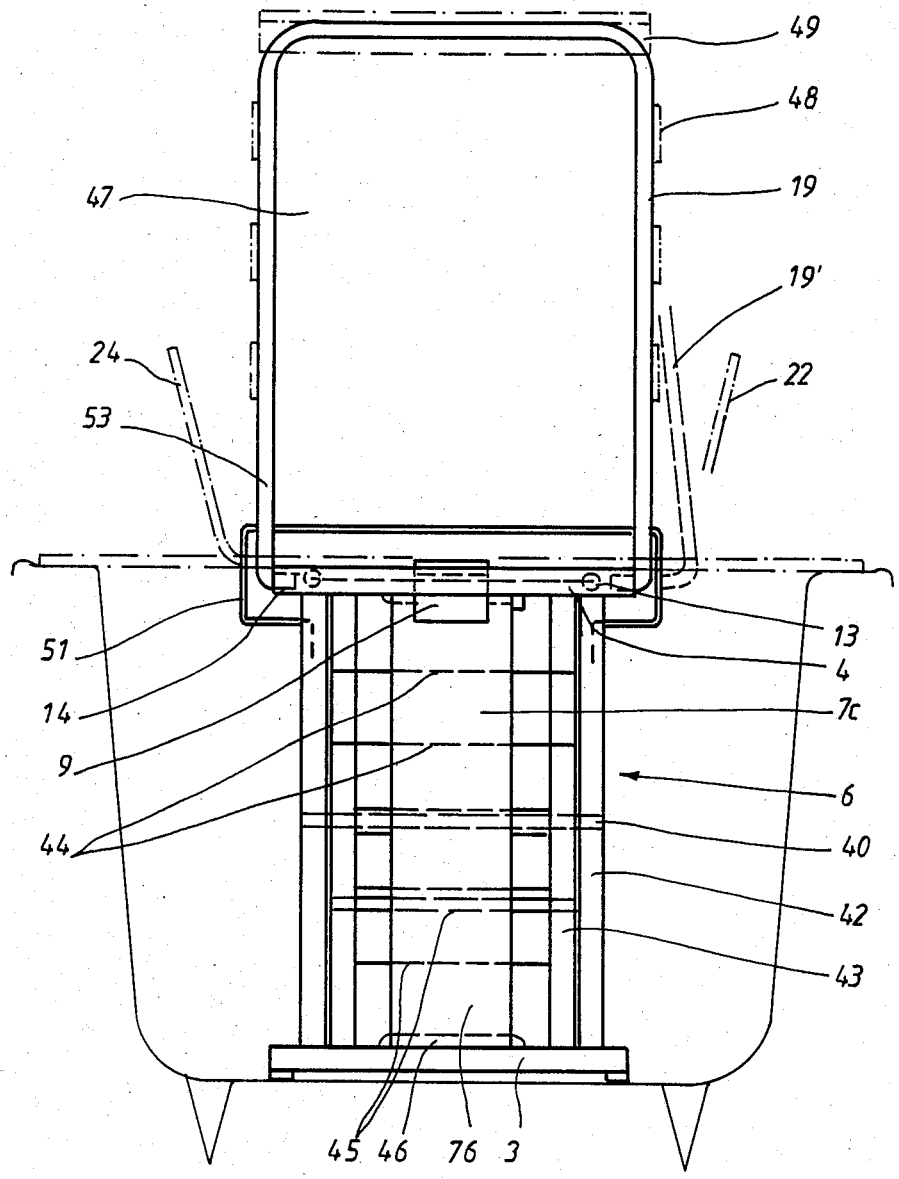
Figure 5:
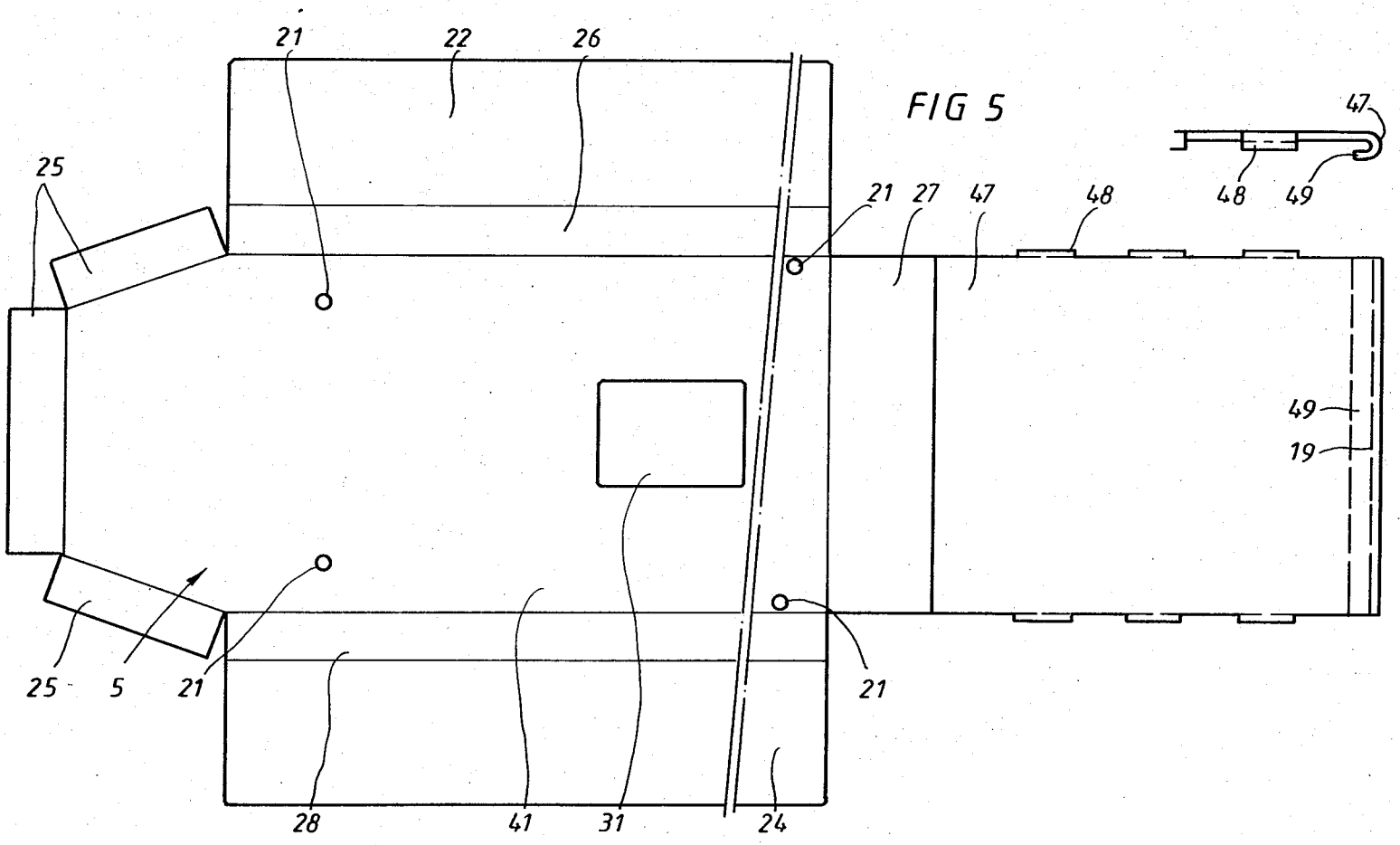
Figure 6:
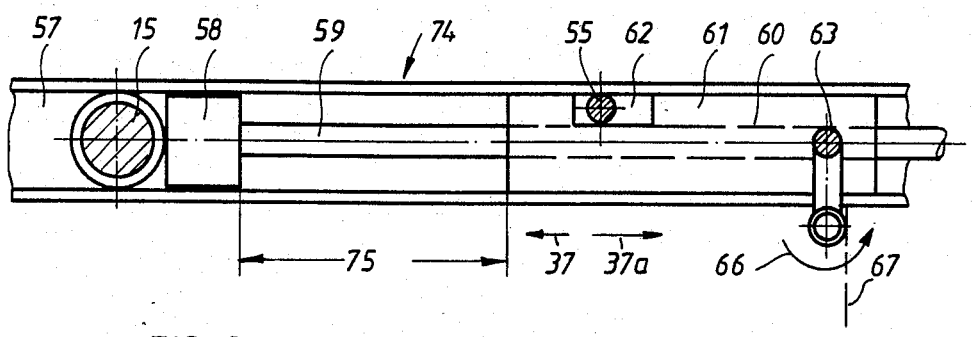
Figure 7:
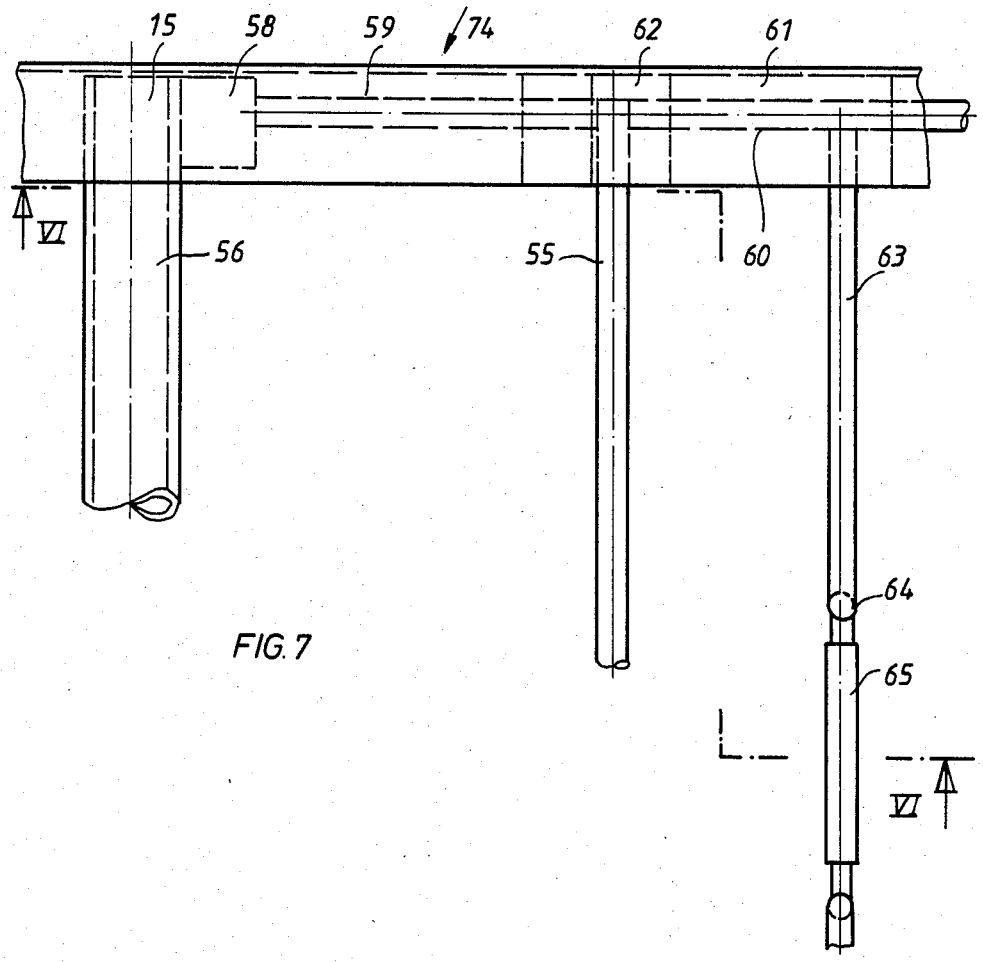

FIG. 1 is a schematically drawn side view of a lifting device, put in the bath tub, in elevated position;

FIG. 2, top view to the lifting device according to FIG. 1;

FIG. 3, side view of the lifting device in folded-up position;

FIG. 4, front view of the lifting device in direction of arrow IV in relation to FIG. 1;

FIG. 5, top view to the supporting plate;

FIG. 6, section according to the line VI—VI in FIG. 7 through a height limitation stop;

FIG. 7, top view to the height limitation stop in FIG. 6;

FIG. 8, side view of a hose holder;

FIG. 9, schematically drawn another possibility for fastening a lifting hose at a slewing frame.

In FIG. 1 the lifting device 1 in a bath tub 2 in elevated position is to be seen. The device consists of a lower frame 3 and an upper frame 4. Between upper frame 4 and lower frame 3 there is arranged a pantograph type frame 6. The pantograph type frame consists of two slewing frames 42, 43, slewable interconnected by a center axle 40.

Each slewing frame 42, 43 has a rectangular shape and consists of longitudinal struts and connecting struts 56, normally mounted at the longitudinal struts. All struts are made of square and respectively round profiles, resistant to distortion and bending. The two slewing frames 42, 43 are fastened at the bottom frame 3 at a corresponding fixed supporting point 17, 18. The slewing frames are mounted in a longitudinal guide, removable in direction of the arrow 37 and its opposite direction, the guide consisting of a roll 16 which gears in the U-profile of the longitudinal guide 57 of the bottom frame 3, the U-profile directed to the interior of the frame. The upper supporting points for the pantograph type frame 6 at the upper frame 4 are formed by the fixed supporting points 13, 14 and, in an analogous way, by removable rolls 15 (removable in direction of the arrow 37 and in opposite direction), the rolls arranged at the respective free end of the slewing frame 42, 43 and removable in the longitudinal guide 57.

In the following, the Z-shaped hose guiding of a lifting hose 7 between the pantograph type frame 6 will be described: Firstly, the lower free end of the lifting hose 7 is tightly screwed on a screw plate 46 at the bottom frame 3. As hose section *7a*, held to the bottom by suitable supporting plates (not drawn), the hose is guided in parallel to the surface of the bottom frame 3, downwardly held to the bottom frame.

In the region of a hose holder 33, the lifting hose 7 now is turned back and lies against a slewing frame 43 with another hose section *7b*. It is important that the turning point at the hose holder 33 consists of a rigid strut 68 (FIG. 8) which, however, is elastically attached at the bottom frame 3 with the aid of a silicone rope 70. In this way it is avoided that the lifting hose 7 can move toward the interior in direction of arrow 37 during pumping and thus cannot transfer forces.

In the hose section *7b*, the lifting hose lies against the slewing frame 43, held by supporting struts for hoses 45. These supporting struts for hoses 45 consist of round profiled bars which stably connect the parallel and adjacent longitudinal struts of the slewing frame 43.

Instead of the mentioned supporting struts for hoses 45, other supporting surfaces can be used, for example supporting plates or the like.

The lifting hose 7 is then guided over the center axle 40 of the pantograph type frame 6, reaching the opposite side of the other slewing frame 42 with the hose section 7c. There are provided the before described supporting struts for hoses 44, so that there are formed stable supporting surfaces.

In the region between the slewing frame 42 and the upper frame 4 a hose holder 32 is again provided the same manner as the hose holder 33. The exact design of this hose holder is described more specifically in conjunction wth FIG. 8.

At the hose holder 32 the lifting hose is turned back and lies in parallel to the underside of the upper frame 4 as another hose section 7d. Its free frontal end is attached to the underside of the upper frame 4 by another screw plate 46.

When actuating a press key 10, a corresponding valve is operated, and, by a forcing hose 38, compressed water will be filled in the lifting hose 7 which enlarges and inflates corresponding to the position shown in FIG. 1. Thus the supporting surfaces 72 are formed between the coordinated and adjacent hose sections 7a, 7b respectively 7c, 7d, i.e. the hose sections 7a, 7b respectively 7c, 7d press mutually, and cause the required large lifting height.

The lifting hose 7 cannot move sideways because stable supporting surfaces at the upper frame 4 are provided by corresponding supporting plates 54 (the same supporting plates are provided at the bottom frame 3); in the region of the slewing frames 42, 43 are provided the described supporting struts for hoses 44, 45.

In order to avoid water draining away in the case of a breaking away of the forcing hose 38 and that the lifting device then unintentionally will be folded, there is provided a back pressure valve 39 which is additionally arranged at the valve box 9. In the valve box 9 are arranged inlet valve and outlet valve (not specifically shown), each valve being operated by a press key 10, 11.

The press keys 10, 11 are made of plastic plates and can be easily actuated; they are mounted at the valve box 9, pivotable at one side with a large area so that they can be operated with any body part, for example also with the foot or with the elbow.

The press keys 10, 11 are arranged in the middle of the upper frame 4; this has the advantage that the complete lifting device can be put on the left or the right in a bath tub 2 without paying attention to the operation of the valve.

A part of the upper frame 4 is a detachable back strut 19 in conjunction with the supporting plate 5 laid upon the upper frame. In the following, the function of these parts will be explained more specifically.

The supporting point 13, 14 for the slewing frame 42 at the upper frame 4 is formed as hollow receiving box in which the bent back strut 19 as U-part with bent legs toward the interior gears an there can be swivelled.

The rear limitation of the swivelling motion is enforced by a stop 50 mounted at the rear side of the upper frame.

In the following, an automatic adjustment of the inclination of the complete back rest 47 in conjunction with the back strut 19 will be described more specifically. When lowering the whole lifting device, i.e. when a press key 10 or 11 is operated, the water is removed from the lifting hose 7, and the pantograph type frame 6 is folded up. By this the inclination of the back rest 47 is adjusted backwards in the direction of the arrow 73. This is achieved by arranging a fastening 52 at the slewing frame 42 which is shiftlessly connected with the upper frame; at the fastening 52 is attached a supporting strut 51 having the shape of a closed U according to FIG. 2. This supporting strut 51 lies with its upper free end in form of a supporting point 53 against the pivotable part of the back strut 19. When the slewing frame 42 is swivelling downward in the direction of the arrow 73, the supporting strut 51 changes its inclination in relation to the horizontal, and at the same time the back strut 19 is swivelled backward in the direction of the arrow 73.

It is important that the stop 50 is detachable. If an automatic adjustment of the back rest 47 is desired, the stop, which has the form of a cork, is removed from supporting point 13, 14. The sole holding of the supporting strut 19 is then effected in the supporting point 53 at the supporting strut 51.

The supporting plate 5 is described more specifically in the FIGS. 1 and 5. It consists of a central part 41, lying on the upper frame 4; the locking with the upper frame 4 is made by centering bolts 21 in form of bent bolts which pass through suitable holes in the central part with its vertical sections; there they are turnable and have on the front side operation openings to twist the bolts. Each bolt has below a horizontal leg which gears into the U-shaped receiving opening of the upper frame when it is turned. By this the locking between the supporting plate 5 and the upper frame 4 is effected, but can be released at any time.

The middle plate has a control opening 31 through which the press keys 10, 11 for the operation of the valves are accessible.

The elastic connecting strips 25, 26, 27, 28 held from the exterior of the sides are joined to the corresponding walls 22, 23,24 by their opposite, overlying ends. In this way a full-surfaced adjustment of the supporting plate to the desired extent of the bathtub 2 is accomplished.

The middle plate consists of the same material as the supporting plate; it has bent stop angles 48 (see FIG. 5 above on the right) which are embracing the back strut 19 and are strongly connected—but detachable—with the back strut 19. Similarly the upper edge of the back rest 47 is provided with a turning-back 49 and embraces the back strut 19 also from above.

FIG. 3 shows that the back strut 19 can be folded so that the complete lifting device 1 takes up less space when not in use; this is not possible with two separate pantograph type frames of the prior art.

A further feature of the present invention will be described more specifically with reference to the FIGS. 6 and 7. This feature concerns a safety device to stop the valves which are operated by the press keys 10, 11; it shall be avoided that, at the elevated position of the pantograph type frame 6 (position according to FIG. 1), a non-intended operation of the inlet valve is possible so that the supply of the lifting hose 7 with compressed water is blocked after the adjusted slewing height is reached.

The purpose of the height-limitation stop 74 is twofold. Firstly, as previously described, one seeks to avoid the possibility that via inadvertent operation of press key 10 or 11 an excess supply of compressed water enters through pressurized hose 38. Secondly, a strong mechanical stop for the entire lifting device is useful. If, for example, a bather with a body weight of about 90 kg (200 pounds) gets up (were there no effective mechanical stop) the lifting device would elevate a little because the lifting hose is slightly compressible and can re-expand a little.

In order to avoid this the height limitation stop 74 is used; in the following, it is described.

The height limitation stop 74 consists of a stop block 58 arranged in the opened U-profile of the longitudinal guide 57; the stop block 58 presses in a force-locking way against the roll 15 of the slewing frame 43. The stop block 58 is strongly connected with an axle 59 which is shiftly supported in longitudinal direction in a bore 60 of a guide block 61. The guide block 61 is strongly connected with a control strut 63 which is rotatably supported within the block; the control strut having in its central region a crank 64, directed below, on which a tube 65 is rotatably set on. The height limitation stop 74, shown in the FIGS. 6 and 7, is arranged in an exactly symmetric and analogous manner in the opposite longitudinal guide 57 of the upper frame.

In the guide block 61, there is provided a longish guide opening 62 in which the connecting strut 55 gears, interconnecting the two parallel longitudinal struts of the upper frame 4. This connecting strut 55 is the shifting stop for the guide block 61 to the left and to the right (direction of arrows 37 and 37*a* in FIG. 6).

The function of the height limitation stop is as follows:

When the pantograph type frame 6 reaches its elevated position, as drawn in FIG. 1, the rolls 15 of the slewing frame 43 run in the direction of the arrow 37*a* against the stop block 58 which also moves in the direction of the arrow 37*a* (to the right in FIG. 6). By this the connecting strut 55 hits the left stop area of the guide opening 62. Simultaneously the control strut 63 moves in direction of the arrow 37*a* to the right and is slewing to the right due to its slewable support in the guide block 61. This slewing motion is transmitted to a control edge 67 (not shown) of the press key 10, 11 for the inlet valve; by this the inlet valve is blocked. Now it is no longer possible to actuate the inlet key by operation of one of the press keys 10 or 11, and the required locking is achieved.

The mechanical locking of the pantograph type frame 6 is effected on the one hand by pressing the roll 15 against the stop block 58, the roll 15 being not able to run on in the direction of the arrow 37*a*, on the other hand by pressing the connecting strut 55, fixed at the frame, against the left stop area of the guide opening 62.

For varying the lifting height, the distance 75 between stop block 58 and guide block 61 now can be controlled.

In a preferred embodiment this is made by setting clips on the axle 59 so that a fixed distance 75 is given and the displacement of the axle 59 in the guide block 61 is limited in longitudinal direction of the bore 60.

These clips can be set on or taken off in a step-like manner so that a gradual limitation of the lifting height of the complete lifting device 1 is possible.

FIG. 8 shows more specifically the fastening of the lifting hose at the upper frame 4. The same fastening is provided at the bottom frame 3.

The lifting hose 7 is guided through a metallic round-profiled strut 68 and turned back. At its two ends the metallic strut 68 is connected with a hook 69; this hook is bent and forms an eyelet through which a silicone rope 70 is guided, the other end of which is guided in form of a closed loop through a hook 71 which is strongly connected with the upper frame 4, respectively with the bottom frame 3.

By this an elastic fastening of the lifting hose 7 is realized; the lifting hose 7 cannot bend in the region of its point of deflection.

The elastic suspension is necessary in order to give a certain motion clearance to the lifting hose 7 when lifting or lowering the lifting device.

When pumping water into the hose, the length of the hose will be slightly reduced; this length variation is equalized by the elastic silicone rope 70.

In FIG. 9 is shown that also another hose guiding is possible. There is shown a lifting hose 80 which is fastened at a pantographic type frame 76, the fastening of the lifting hose at the frame 76 being made in exactly opposite manner as shown in FIG. 1. The lifting hose 80 is fastened with its lower end at a supporting plate 81 of the slewing frame 82. The hose is then guided over the center axle and fastened above at another supporting plate 79 of the slewing frame. The proposal, therefore, is a coupled motion of the lifting hose 80. In this embodiment it is important that is shown that the most significant features are the mutual supporting surfaces 72; thus the hose surfaces prop one against another without regard whether the Z-shape of the hose fastening is chosen in normal position or in the position of its mirror image.

We claim:

1. A lifting device for use in a bath tub comprising a lower frame lying on the base of the bath tub, an upper frame parallel to the lower frame and adjustable in height, a supporting plate fixed to the upper frame, between the lower frame and the upper frame also a pantograph type frame adjustable in height by means of a lifting hose supported between the lower frame and the upper frame, characterized by a pantograph type frame (6,76) consists of two interconnected slewing frames (42,43,82,83) pivotable upon the center axle (40), between the slewing frames, and a Z-shaped lifting hose (7,80) sectionally fastened in such a manner that the horizontal hose sections (7*a*,7*d*) form a cusp with the corresponding adjacent inclined hose sections (7*b*,7*c*).

2. A lifting device according to claim 1, wherein the first hose section (7*a*) is lying horizontally on the lower frame (3) and forms a cusp with the second hose section (7*b*) fastened at the second slewing frame, the third hose section (7*c*) forms a cusp with the horizontally arranged fourth hose section (7*d*) fastened at the upper frame (4).

3. A lifting device according to claim 1 or 2, wherein fastening of the lifting hose (7) is made by a hose holder (32,33) variable in length, in the region of the pantograph type frame (6).

4. A lifting device according to claim 3, characterized by a hose holder (32,33), variable in length, consisting of a rigid strut (69) on which the lifting hose (7) is placed, and a hook (69) at each end of the strut (68), which bears an elastic silicone rope (70) fastened to the frame at hook (71).

5. A lifting device according to any one of claims 1, 2, 3, or 4, characterized by an adjustable back rest (19,47) whose slope is effected by a fastening (52) on a U-shaped supporting strut (51) at the slewable part of frame (42) beyond its bearing point (13,14) on upper slewing frame (4), the supporting strut (51) being laid with its base against the slewable part of the back rest (19,47) supported by the upper frame (4).

6. A lifting device according to any one of claims 1 to 4 wherein a height limit stop (74) is provided for locking the elevated position of the pantograph-type frame (6) accuated by blocking the inlet valve box (9), said height limit stop (74) consisting of two, symmetrical guides rigidly connected by a strut (55) across the width of the upper frame (4), each of said guides consisting of a guide block (61) movable along the upper frame near the guide opening (62) having a bore (60) through which axle (59) acts and at the end of which is provided stop block (58), which acts against roll (15) at the front end of slewing frame (43), said guide block (61) further provided with a crankable control strut (63) along control edge (67) of press key (10 or 11) and slewed when the guide block (61) is removed.

7. A lifting device according to claim 6 wherein the elevated position of the pantograph-type frame (6) can be fixed at any height.

* * * * *